US007557065B2

(12) United States Patent
Oda et al.

(10) Patent No.: US 7,557,065 B2
(45) Date of Patent: Jul. 7, 2009

(54) METHOD FOR PRODUCING MATERIAL CONTAINING SENSITIZER DISPERSED THEREIN FOR THERMAL RECORDING ARTICLE AND A THERMAL RECORDING ARTICLE

(75) Inventors: Shigeru Oda, Ibaraki (JP); Eiji Kawabata, Ibaraki (JP); Takaaki Mori, Ibaraki (JP); Tjang Kie Tan, Ibaraki (JP); Hiroshi Sumitomo, Ibaraki (JP); Yoshito Nakagawa, Ibaraki (JP)

(73) Assignee: Sanko Co., Ltd., Fukuoka (JP)

( * ) Notice: Subject to any disclaimer, the term of this patent is extended or adjusted under 35 U.S.C. 154(b) by 443 days.

(21) Appl. No.: 10/560,942

(22) PCT Filed: Apr. 8, 2004

(86) PCT No.: PCT/JP2004/005074

§ 371 (c)(1),
(2), (4) Date: Dec. 15, 2005

(87) PCT Pub. No.: WO2005/000596

PCT Pub. Date: Jan. 6, 2005

(65) Prior Publication Data

US 2006/0252645 A1 Nov. 9, 2006

(30) Foreign Application Priority Data

Jun. 25, 2003 (JP) ..... 2003/180869

(51) Int. Cl.
*B41M 5/337* (2006.01)

(52) U.S. Cl. ..... 503/209; 106/31.16; 503/208; 503/216; 503/217; 503/220; 503/221

(58) Field of Classification Search ..... None
See application file for complete search history.

(56) References Cited

FOREIGN PATENT DOCUMENTS

| | | | |
|---|---|---|---|
| JP | 1-123787 | A | 5/1989 |
| JP | 2-194992 | A | 8/1990 |
| JP | 5-168965 | A | 7/1993 |
| JP | 2001-246863 | A | 9/2001 |
| JP | 2001-301338 | A | 10/2001 |

*Primary Examiner*—Bruce H Hess
(74) *Attorney, Agent, or Firm*—Frommer Lawrence & Haug LLP; Ronald R. Santucci

(57) ABSTRACT

The invention provides a heat-sensitive recording material, which is highly sensitive, is almost free of staining on the background, and gives a recorded image excellent in stability during storage, by using a finely divided sensitizer dispersion excellent in shelf stability produced in a short time with high volumetric efficiency. The invention relates to a method of producing a sensitizer dispersion, which comprises emulsifying and finely dividing a heat-sensitive recording sensitizer by melting under heating in an aqueous emulsifying dispersant, and then crystallizing the finely divided emulsified dispersion under rapid cooling, wherein the sensitizer is at least one member selected from the group consisting of 1,2-bis(phenoxy)ethane, 1,2-bis(3-methylphenoxy)ethane, 1,2-bis(4-methylphenoxy)ethane, p-benzylbiphenyl, di-p-methylbenzyl oxalate, and β-naphthyl benzyl ether.

3 Claims, No Drawings

METHOD FOR PRODUCING MATERIAL CONTAINING SENSITIZER DISPERSED THEREIN FOR THERMAL RECORDING ARTICLE AND A THERMAL RECORDING ARTICLE

This application is a 371 of PCT/JP2004/005074 filed on Apr. 8, 2004, published on Jan. 6, 2005 under publication number WO 2005/000596 A1 which claims priority benefits from Japanese Patent Application Number 2003-180869 filed Jun. 25, 2003.

FIELD OF THE INVENTION

The present invention relates to a method of producing a dispersion having a sensitizer finely divided as a highly sensitizing material for heat-sensitive recording and a heat-sensitive recording material using the sensitizer dispersion.

DESCRIPTION OF THE PRIOR ART

A heat-sensitive recording material utilizing a thermal coloring reaction among a dye, a developer and a sensitizer is used widely in facsimiles, printers, labels, tickets etc. because its system is inexpensive.

With respect to the heat-sensitive recording material, a sensitizer is extensively studied for improving coloration sensitivity. For example, it is disclosed that when a sensitizer 1,2-bis(3-methylphenoxy)ethane, when ground together with a dye by a sand grinder (wet grinder) until the average particle diameter becomes 0.40 μm, 0.25 μm and 0.10 μm, is excellent in coloration (see, for example, JP-A 5-168965). At present, however, the sensitizer is used with an average particle diameter of 1 to 3 μm, as shown in Table 1. In grinding technology with the sand grinder, there is a problem that grinding of particles until the average diameter is reduced to 1 to 3 μm requires much time. When a ground product having an average particle diameter of 0.40 to 0.10 μm is to be obtained, much more time is required, so technology with the sand grinder at present is far from practical technology.

TABLE 1

| Literatures | Ground Material | Grinding Method | Average Particle Diameter (μm) |
|---|---|---|---|
| JP-A 2-70482 | Mixture of 1-phenoxy-2-naphthoxy (1)-ethane and 3-(N-cyclohexyl-N-methylamino)-6-methyl-7-phenyl aminofluoran | Sand grinder | 3 |
| JP-A 10-24657 | 2-Benzyloxy naphthalene | Sand grinder | 1.0 |
| JP-A 10-44601 | Mixture of di-p-methyl benzyl oxalate and 4-hydroxy-4'-isopropoxy-diphenyl sulfone | Sand grinder | 1.5 |
| JP-A 10-100534 | 1-(4-Methylphenoxy)-2-(2-naphthoxy)ethane | Sand grinder | 1.5 |
| JP-A 10-100537 | 1,2-Di(3-methoxyphenoxy)ethane | Sand grinder | 1.0 |

When a sensitizer dispersion obtained by grinding technology with a sand grinder is kept and stored for a long time, the dispersion is sedimented in a lower layer, and the sediment is firmly set and thus hardly dissociated for re-dispersion prior to use, so there is a disadvantage that considerable power is required for dissociation.

SUMMARY OF THE INVENTION

The problem of the present invention is to solve the disadvantages of the prior art descried above. That is, the object of the present invention is to provide a heat-sensitive recording material, which is highly sensitive, is almost free of staining on the background thereof, and gives a recorded image excellent in stability during storage, by using a finely divided sensitizer dispersion excellent in shelf stability produced in a short time with high volumetric efficiency.

As a result of extensive study for solving the problem described above, the present inventors found, from a viewpoint different from the conventional grinding method with a sand grinder as a method of finely dividing a sensitizer, that when an aqueous emulsifying dispersant and a sensitizer are melted under heating and emulsified into fine particles in an oil-aqueous system, an emulsified sensitizer dispersion having an average particle diameter of 3 μm or less can be obtained in a short time with high volumetric efficiency. As a result of further extensive study, they found that when the dispersion having a sensitizer finely divided by melting under heating is crystallized under rapid cooling, a dispersion excellent in fluidity can be obtained without destroying emulsification, and even if this product is kept and stored for a long time, the resulting sensitizer dispersion is excellent in re-dispersibility. Further, they found that by using this sensitizer dispersion, a heat-sensitive recording material giving a recorded image excellent in stability during storage can be obtained with high sensitivity with no or less fog on the background, and the present invention was thereby completed.

Briefly, the present invention encompasses the following inventions:

(1) A method of producing a sensitizer dispersion, which comprises emulsifying and finely dividing a heat-sensitive recording sensitizer by melting under heating in an aqueous emulsifying dispersant, and then crystallizing the finely divided emulsified dispersion under rapid cooling, wherein the sensitizer is at least one member selected from the group consisting of 1,2-bis(phenoxy)ethane, 1,2-bis(3-methylphenoxy)ethane, 1,2-bis(4-methylphenoxy)ethane, p-benzylbiphenyl, di-p-methylbenzyl oxalate, and β-naphthyl benzyl ether.

(2) The method of producing a sensitizer dispersion according to the above-mentioned (1), wherein the emulsified sensitizer dispersion is crystallized under rapid cooling, and the temperature after the rapid cooling is 50° C. or less.

(3) The method of producing a sensitizer dispersion according to the above-mentioned (1) or (2), wherein the sensitizer is emulsified and finely divided such that the solids content of a mixture of the sensitizer and the emulsifying dispersant becomes 10 to 65 wt %, and the average particle diameter thereof becomes 3 μm or less.

(4) A sensitizer dispersion obtained by the method described in any one of the above-mentioned (1) to (3).

(5) A method of producing a mixed dispersion for a heat-sensitive recording material, which comprises wet-grinding the sensitizer dispersion of the above-mentioned (4) and a dye for a heat-sensitive recording material or a developer for a heat-sensitive recording material.

(6) A mixed dispersion for a heat-sensitive recording material, which is obtained by the method described in the above-mentioned (5).

(7) A heat-sensitive recording material comprising the sensitizer dispersion of the above-mentioned (4) or the mixed dispersion for a heat-sensitive recording material of the above-mentioned (6) formed on the surface of a support.

(8) The heat-sensitive recording material according to the above-mentioned (7), wherein the dye is at least one member selected from the group consisting of 3-N,N-dibutylamino-6-methyl-7-anilinofluoran, 3-N,N-diethylamino-6-methyl-7-anilinofluoran, 3-N,N-diamylamino-6-methyl-7-anilinofluoran, 3-N,N-diethylamino-7-(m-trifluoromethylanilino) fluoran, 3-(N-isoamyl-N-ethyl)amino-6-methyl-7-anilinofluoran, 3-(N-p-tolyl-N-ethyl)amino-6-methyl-7-anilinofluoran, 3-(N-isopentyl-N-ethyl)amino-6-methyl-7-anilinofluoran, 3-(N-cyclohexyl-N-methyl)amino-6-methyl-7-anilinofluoran, 3-N,N-diethylamino-6-chloro-7-anilinofluoran and 3,3-bis(4-dimethylaminophenyl)-6-dimethylaminophthalide.

(9) The heat-sensitive recording material according to the above-mentioned (7) or (8), wherein the developer is at least one member selected from the group consisting of 4,4'-dihydroxy diphenyl sulfone, 2,4'-dihydroxy diphenyl sulfone, 4-hydroxy-4'-isopropoxy diphenyl sulfone, bis(3-allyl-4-hydroxyphenyl)sulfone, 2,2-bis(4-hydroxyphenyl)propane, bis (4-hydroxyphenylthioethoxy)methane, bis(4-hydroxyphenylthioethyl) ether, 4,4'-cyclohexylidene diphenol, 4-benzyloxy-4'-hydroxy diphenyl sulfone, 4-allyloxy-4'-hydroxy diphenyl sulfone, benzyl-p-hydroxybenzoate, 3,5-di (α-methylbenzyl) salicylic acid and its zinc salt, 2,4-bis(phenylsulfonyl)phenol, 2,4-bis(phenylsulfonyl)-5-methyl phenol, 4-hydroxy benzene sulfoanilide, a reaction mixture of toluene diisocyanate, diaminodiphenyl sulfone and phenol, 4,4'-bis(p-toluenesulfonylaminocarbonylamino)-diphenyl methane, p-toluene sulfonyl aminocarboanilide, α,α'-bis{4-(p-hydroxyphenylsulfone) phenoxy}-p-xylene, a dehydration condensate of a 2,2-bis(hydroxymethyl-1,3-propane diol polycondensate and 4-hydroxybenzoic acid, and 4,4'-{oxybis(ethyleneoxy-p-phenylene sulfonyl)}diphenol.

By the method of producing a sensitizer dispersion according to the present invention, a sensitizer for heat-sensitive recording material can be emulsified in a short time to form fine particles, and as compared with the prior-art sensitizer dispersion, the resulting sensitizer dispersion even when used as a coating material for heat-sensitive recording material after being kept and stored for a long time can economize significantly on power and time for re-dispersion, can be used to prepare a coating solution always in a short time, and is thus extremely advantageous in producing a heat-sensitive recording material. The heat-sensitive recording material using the resulting sensitizer dispersion is excellent in coloration and gives a recorded image excellent in stability during storage, with no or less fog on the background under heating and humidity.

DETAILED DESCRIPTION OF THE PREFERRED EMBODIMENTS

Hereinafter, the mode for carrying out the invention is described in detail.

Usually, a heat-sensitive recording material requiring highly sensitive coloration contains a finely divided sensitizer on its heat-sensitive recording layer. When the sensitizer used therein has a too high melting point, it fails to exhibit functions as a sensitizer, thus failing to improve the coloring properties (recording sensitivity) of the heat-sensitive recording material. On one hand, when the melting point is too low, there is a problem that the heat-sensitive recording material, upon exposure to high temperatures, is colored to undergo staining (background fog). For this reason, the melting point of the sensitizer is preferably 80 to 130° C.

Accordingly, the sensitizer dispersion of the present invention is characterized by using a sensitizer having a melting point of 80 to 130° C., which is at least one member selected from the group consisting of 1,2-bis(phenoxy)ethane (mp 96° C.), 1,2-bis(3-methylphenoxy)ethane (mp 98° C.), 1,2-bis(4-methylphenoxy)ethane (mp 125° C.), p-benzylbiphenyl (mp 86° C.), di-p-methylbenzyl oxalate (mp 103° C.), and β-naphthyl benzyl ether (mp 101° C.).

As a matter of course, the sensitizer when used in combination with a dye and a developer described later is particularly superior in coloration sensitivity, in storage of a recorded image, and in staining on the background. The mode for carrying out the invention is described in detail by referring to a method of producing a sensitizer dispersion and a heat-sensitive recording material using the same, respectively.

First, the method of producing a sensitizer dispersion according to the first aspect of the invention is described.

The present invention provides a method of finely dividing a sensitizer inexpensively in a short time with high volumetric efficiency in place of the conventional grinding method with a sand grinder, and its technical feature lies in emulsifying and finely dividing a sensitizer under heating to the temperature at which the sensitizer is melted. The emulsifying dispersant used herein includes polysulfonates, poly(sodium acrylate), polyvinyl alcohols (those having various degrees of saponification, pH values, denaturation, and degrees of polymerization), carboxymethyl cellulose, hydroxyethyl cellulose, hydroxypropyl cellulose, methyl cellulose, hydroxyethyl methyl cellulose, hydroxypropyl methyl cellulose, polyacrylamide, starch, a styrene/maleic anhydride copolymer salt, an ethylene/acrylic acid copolymer salt, a styrene/butadiene copolymer, urea resin, melamine resin, amide resin, a methyl methacrylate/butadiene copolymer, a methyl methacrylate/styrene/butadiene copolymer, an acrylonitrile/butadiene copolymer, a styrene polymer, an isoprene polymer, a butadiene polymer, a vinyl acetate/acrylate copolymer, an acrylate polymer, a vinyl acetate/ethylene copolymer, a vinyl chloride polymer, a vinylidene chloride polymer, sulfosuccinate, alkyl benzene sulfonate, sodium alkyl sulfate, alkyl ammonium chloride, trimethyl alkyl ammonium bromide, polyoxyalkylene alkyl ether, polyoxyalkylene alkyl phenyl ether, polyoxyethyl sorbitan alkyl ester and alkyl amino acid or a combination thereof, and emulsifying dispersants having a high emulsifying ability but easily foaming are poor in operativeness and not preferable as the emulsifying dispersant, and emulsifying dispersants which easily stain a heat-sensitive recording material, are inferior in water resistance or cause desensitization are not preferable either. Accordingly, particularly preferable among those described above are polyvinyl alcohol, various celluloses, alkyl sulfate, dialkyl sulfosuccinate, polyoxyethylene alkyl sulfate, polyoxyalkylene alkyl ether, and polyoxyalkylene alkyl phenyl ether.

The amount of the emulsifying dispersant used is preferably 0.01 to 10 wt % based on the sensitizer. The amount is more preferably 0.05 to 6 wt %. When the amount is less than 0.01 wt %, sufficient emulsification and dispersion are difficult, while when the amount is higher than 10 wt %, the emulsified dispersion significantly foams, and a heat-sensitive recording material using the same is disadvantageous in deterioration in water resistance, etc.

An apparatus for emulsifying and finely dividing the sensitizer with an aqueous emulsifying dispersant under heating to the temperature at which the sensitizer is melted is exemplified by (1) a high-speed revolution-type emulsifying apparatus of homomixer type, comb type, or continuous jet generation type, (2) an emulsifying apparatus of colloid mill type, (3) a high-pressure emulsifying apparatus, (4) an emulsifying apparatus of roll mill type, (5) an emulsifying apparatus of sonication type, and (6) a membrane-type emulsifying apparatus, or a combination thereof.

By using such apparatus, the solids content of a mixed dispersion of the sensitizer and the aqueous emulsifying dispersant during formation into fine particles by emulsification is made preferably 10 to 65 wt %. When the solids content is higher than 65 wt %, there occurs phase reversal of emulsion in the emulsifying system, while a solids content of less than 10 wt % is economically wasteful due to inferior treatment efficiency.

When the sensitizer is finely divided by emulsification with the above apparatus, the average particle diameter thereof is 3.0 μm or less, preferably 1.5 μm or less, while when high coloration sensitivity is required, the average particle diameter is preferably 0.5 μm or less. When the average particle diameter is greater than 3.0 μm, there is a problem that expected coloration sensitivity is hardly achieved.

In the present invention, another technical feature lies in crystallizing, under rapid cooling, the dispersion of the sensitizer having been emulsified and finely divided by melting under heating. The means of crystallization under rapid cooling, together with the means of finely dividing the sensitizer by melting under heating in the previous stage, forms an important constitution in the present invention. By this crystallization under rapid cooling, a dispersion excellent in fluidity without destroying emulsification can be obtained, and a sensitizer dispersion excellent in stability during storage for a long time can be obtained. When the dispersion of the sensitizer finely divided by melting under heating is cooled slowly, on the other hand, the sensitizer particles grow into giant crystals (several tens μm) thus failing to exhibit functions inherent in the sensitizer as a coloration improver in a heat-sensitive recording material. The crystallization conditions under rapid cooling are more specifically that it is important for the finely divided sensitizer dispersion to be rapidly cooled to preferably 50° C. or less, more preferably 30° C. or less. The cooling method includes a method wherein the emulsified and finely divided emulsified sensitizer dispersion is (1) cooled rapidly to preferably 50° C. or less, more preferably 30° C. or less by introducing it into cold water, cold water containing an aqueous emulsifying dispersant, or a previously obtained cooled emulsified sensitizer dispersion, and/or (2) cooled rapidly to preferably 50° C. or less, more preferably 30° C. or less by passing it through a heat exchanger designed to be cooled with a refrigerant or the like. The cooling rate until the intended temperature is reached is preferably 3° C./min or more, more preferably 10° C./min or more.

To verify that the method of the present invention is effective as a method of producing a sensitizer dispersion, the comparison of the method of the present invention with the conventional sand grinder method is shown in Table 2.

TABLE 2

| | Average particle diameter (μm) | Kettle volume (ml) | Amount of sensitizer (parts) | Treatment time (min) |
|---|---|---|---|---|
| Method of the Invention | 2.0 | 350 | 150 | 0.5 |
| Method of the Invention | 1.0 | 350 | 150 | 1.5 |
| Method of the Invention | 0.3 | 1,000 | 150 | 21.5 |
| Method of the Invention | 0.3 | 500 | 210 | 3.0 |
| Sand grinder method | 2.0 | 400 | 50 | 90 |

TABLE 2-continued

| | Average particle diameter (μm) | Kettle volume (ml) | Amount of sensitizer (parts) | Treatment time (min) |
|---|---|---|---|---|
| Sand grinder method | 1.0 | 400 | 50 | 180 |
| Sand grinder method | 0.3 | 400 | 50 | 480 |

As is evident from Table 2 which will be described in more detail in the Examples below, the treatment time required for milling to attain the desired average particle diameter by the conventional sand grinder method is that the time is 90 minutes for attaining the average particle diameter of 2.0 μm, 180 minutes for 1.0 μm, or 480 minutes for 0.3 μm, while the time required for milling to attain the corresponding average particle diameter by the method of the present invention is 0.5 minute for the average particle diameter of 2.0 μm, 1.5 minutes for 1.0 μm, and 3.0 to 21.5 minutes for 0.3 μm, thus revealing that the method of the invention is significantly advantageous in respect of necessary treatment time.

It is also evident that the method of the present invention is also advantageous in respect of (amount of sensitizer/kettle volume).

When the average particle diameter is particularly about 1 μm or less, the dispersion of the sensitizer finely divided by the conventional sand grinder method is sedimented in a lower layer during long-term storage, to form a firmly set sediment. Accordingly, when the sediment is dissociated and re-dispersed prior to use, there is a problem of lack of shelf stability making considerable power and time necessary, so sufficient attention should be paid to the method of storing it.

On the other hand, the dispersion of the sensitizer finely divided by the method of the present invention has a surprising feature that a sediment of the dispersion even having an average particle diameter of about 1.0 to 2.0 μm is extremely easily re-dispersed for use after long-term storage, and requires less power and time for re-dispersion. Such feature of the sensitizer dispersion is brought about for the first time by the method of the present invention, and considered attributable to formation of the particles in a spherical shape. Such feature is extremely advantageous in production of a heat-sensitive recording material because as compared with the prior-art sensitizer dispersion, the sensitizer dispersion even when left and stored for a long time and used as a coating material for heat-sensitive recording material can economize significantly on power and time for dissociation and can used to prepare a coating solution always in a short time.

As a matter of course, a defoaming agent based on higher alcohol, aliphatic ester, oil, silicone, denatured hydrocarbon oil or paraffin may be used in production of the sensitizer dispersion.

The method of producing the emulsified sensitizer dispersion of the present invention may be carried out in a batch system, or may be carried out in the following continuous system. That is, the continuous system can be as follows: (1) The sensitizer is melted by heating to its melting point or more, while a dispersant in water is dissolved at about 100° C. Then, (2) the two are introduced continuously at a desired ratio into a mixer and mixed in a dispersed state in the form of oil and water. Further, (3) this dispersion is introduced continuously into an emulsifying machine to produce an emulsified dispersion of the sensitizer. (4) Finally, the emulsified dispersion is discharged continuously from the emulsifying machine and introduced into a cooling bath equipped with a cooling unit by which the sensitizer in the emulsified sensitizer dispersion is crystallized under rapid cooling. (5) If necessary, the product is passed through an apparatus for dissociating aggregates.

The second aspect of the invention relates to a heat-sensitive recording material using the sensitizer dispersion produced by the method described above.

First, the method of using the sensitizer dispersion in a heat-sensitive recording material includes:

(1) the emulsified sensitizer dispersion is used as it is, (2) the emulsified sensitizer dispersion is used in combination with another previously finely divided sensitizer dispersion, (3) the emulsified sensitizer dispersion and a dye for heat-sensitive recording material are ground with a sand grinder or the like, and used in the form of a mixed dispersion of the sensitizer and the dye, and (4) the emulsified sensitizer dispersion and a developer for heat-sensitive recording material are ground with a sand grinder or the like, and used in the form of a mixed dispersion of the sensitizer and the developer, as well as a combination of the above.

In the above-mentioned (2), the sensitizer constituting another previously finely divided sensitizer dispersion can include diphenyl sulfone, dibenzyl oxalate, p-chlorobenzyl oxalate, stearic acid amide, ethylene bis-stearic acid amide, m-terphenyl, p-biphenyl-p-tolyl ether etc. Among these materials, stearic acid amide and ethylene bis-stearic acid amide are preferable as a coloration improver.

A dye, a developer, a pigment, an adhesive, a light resistance improver, a water resistance improver, a plasticizer resistance improver, metallic soap, wax, a surfactant, a defoaming agent, a dispersant etc. can be used if necessary in the sensitizer dispersion in the above-mentioned (1) to (4) in order to produce a heat-sensitive recording material.

Hereinafter, the respective constituent elements are described respectively.

As the dye, conventionally known compounds such as fluoran compounds, indolyl phthalide compounds, divinyl phthalide compounds, pyridine compounds, spiro compounds, fluorenone compounds, triaryl methane compounds and diaryl methane compounds can be preferably used. Preferable examples include:

fluoran compounds such as

3-N,N-butylamino-6-methyl-7-anilinofluoran,
3-N,N-diethylamino-6-methyl-7-anilinofluoran,
3-pyrrolidino-6-methyl-7-anilinofluoran,
3-morpholino-6-methyl-7-anilinofluoran,
3-N,N-dimethylamino-6-methyl-7-anilinofluoran,
3-diethylamino-6-methyl-7-anilinofluoran,
3-N,N-di-n-butylamino-6-methyl-7-anilinofluoran,
3-N,N-di-n-pentylamino-6-methyl-7-anilinofluoran,
3-N,N-di-n-octylamino-6-methyl-7-anilinofluoran,
3-N,N-diamylamino-6-methyl-7-anilinofluoran,
3-N,N-diethylamino-7-(m-trifluoromethylanilino)fluoran,
3-(N-n-propyl-N-methyl)amino-6-methyl-7-anilinofluoran,
3-(N-n-butyl-N-methyl)amino-6-methyl-7-anilinofluoran,
3-(N-n-butyl-N-ethyl)amino-6-methyl-7-anilinofluoran,
3-(N-isoamyl-N-ethyl)amino-6-methyl-7-anilinofluoran,
3-(N-isobutyl-N-methyl)amino-6-methyl-7-anilinofluoran,
3-(N-isobutyl-N-ethyl)amino-6-methyl-7-anilinofluoran,
3-(N-n-pentyl-N-ethyl)amino-6-methyl-7-anilinofluoran,
3-(N-isopentyl-N-ethyl)amino-6-methyl-7-anilinofluoran,
3-(N-n-hexyl-N-ethyl)amino-6-methyl-7-anilinofluoran,
3-(N-n-octyl-N-ethyl)amino-6-methyl-7-anilinofluoran,
3-(N-p-tolyl-N-ethyl)amino-6-methyl-7-anilinofluoran,
3-(N-cyclopentyl-N-ethyl)amino-6-methyl-7-anilinofluoran,
3-(N-cyclohexyl-N-methyl)amino-6-methyl-7-anilinofluoran,
3-(N-cyclohexyl-N-n-propyl)amino-6-methyl-7-anilinofluoran,
3-(N-cyclohexyl-N-n-butyl)amino-6-methyl-7-anilinofluoran,
3-(N-cyclopentyl-N-n-hexyl)amino-6-methyl-7-anilinofluoran,
3-(N-cyclohexyl-N-n-octyl)amino-6-methyl-7-anilinofluoran,
3-N,N-diethyl-6-chloro-7-anilinofluoran,
3-N-(2-methoxyethyl)-N-isobutylamino-6-methyl-7-anilinofluoran,
3-N-(2-ethoxyethyl)-N-ethylamino-6-methyl-7-anilinofluoran,
3-N-(3-methoxypropyl)-N-methylamino-6-methyl-7-anilinofluoran,
3-N-(3-ethoxypropyl)-N-methylamino-6-methyl-7-anilinofluoran,
3-N-(3-ethoxypropyl)-N-ethylamino-6-methyl-7-anilinofluoran,
3-N-(2-tetrahydrofurfuryl)-N-ethylamino-6-methyl-7-anilinofluoran,
3-N-(4-methylphenyl)-N-ethylamino-6-methyl-7-anilinofluoran,
3,6-dimethoxy fluoran, 3-dimethylamino-7-methoxy fluoran,
3-diethylamino-7-methoxy fluoran, 3-diethylamino-7-methyl fluoran,
3-N-cyclohexyl-N-n-butylamino-7-methyl fluoran,
3-N-ethyl-N-isopentylamino-7-methyl fluoran,
3-diethylamino-7-chlorofluoran,
3-N,N-diethylamino-6-chloro-7-anilionofluoran,
3-diethylamino-6-methyl-7-chlorofluoran, 3-diethylamino-6,7-dimethyl fluoran, 3,6-bis(diphenylamino)fluoran,
3-diethylamino-7-dibenzylaminofluoran,
3-di-n-butylamino-7-dibenzylaminofluoran,
3-diethylamino-7-n-octylaminofluoran, 3-diethylamino-7-anilinofluoran,
3-N-ethyl-N-isopentyl fluoran compounds etc.;

indolyl phthalide compounds such as 3,3-bis(p-dimethylaminophenyl)-6-dimethylaminophthalamide,
3,3-bis(1,2-dimethylindol-3-yl)-5-dimethylaminophthalide,
3,3-bis(1,2-dimethylindol-3-yl)-6-dimethylaminophthalide,
3,3-bis(2-phenylindol-3-yl)-6-dimethylaminophthalide,
3,3-bis(1-ethyl-2-methylindol-3-yl) phthalide,
3,3-bis(1-octyl-2-methylindol-3-yl) phthalide,
3-(4-dimethylaminophenyl)-3-(1,2-dimethylindol-3-yl) phthalide,
3-(4-dimethylaminophenyl)-3-(2-methylindol-3-yl) phthalide,
3-(2-ethoxyl-4-diethylaminophenyl)-3-(1-ethyl-2-methylindol-3-yl) phthalide,
3-(2-ethoxy-4-dibutylaminophenyl)-3-(1-ethyl-2-methylindol-3-yl) phthalide,
3-(2-ethoxyl-4-diethylaminophenyl)-3-(1-octyl-2-methylindol-3-yl) phthalide etc.;

divinyl phthalide compounds such as 3,3-bis[2,2-bis(4-dimethylaminophenyl) ethenyl]-4,5,6,7-tetrachlorophthalide, 3,3-bis[2,2-bis(4-pyrrolidinophenyl) ethenyl]-4,5,6,7-tetrabromophthalide,
3,3-bis[2-(4-methoxyphenyl)-2-(4-dimethylaminophenyl) ethenyl]-4,5,6,7-tetrachlorophthalide, 3,3-bis[2-(4-methyoxyphenyl)-2-(4-pyrrolidinophenyl) ethenyl]-4,5,6,7-tetrachlorophthalide etc.;

pyridine compounds such as 3-(2-ethoxy-4-diethylaminophenyl)-3-(1-ethyl-2-methylindol-3-yl)-4 or 7-azaphthalide, 3-(2-ethoxy-4-diethylaminophenyl)-3-(1-ethyl-2-phenylindol-3-yl)-4 or 7-azaphthalide, 3-(2-ethoxy-4-diethylaminophenyl)-3-(1-octyl-2-methylindol-3-yl)-4 or 7-azaphthalide, 3-(2-hexyloxy-4-diethylaminophenyl)-3-(1-ethyl-2-methylindol-3-yl)-4 or 7-azaphthalide, 3-(2-n-butoxy-4-diethylaminophenyl)-3-(1-ethyl-2-phenylindol-3-yl)-4 or 7-azaphthalide, 3-(2-methyl-4-diethylaminophenyl)-3-(1-ethyl-2-methylindol-3-yl)-4 or 7-azaphthalide, 3-(2-methyl-4-diethylaminophenyl)-3-(1-n-octyl-2-methylindol-3-yl)-4 or 7-azaphthalide, 3,3-bis(2-methoxy-4-diethylaminophenyl)-4 or 7-azaphthalide, 3,3-bis(2-ethoxy-4-diethylaminophenyl)-4 or 7-azaphthalide etc.;

spiro compounds such as 3-methyl spirodinaphthopyran, 3-ethyl spirodinaphthopyran, 3-phenyl spirodinaphthopyran, 3-benzyl spirodinaphthopyran, 3-methyl naphtho-(3-methoxybenzo) spiropyran, 3-propyl spirodinaphthopyran etc.;

fluorene compounds such as 3,6-bis(diethylamino) fluorene-9-spiro-3-(6-dimethylamino) phthalide, 3-diethylamino-6-(N-allyl-N-methylamino) fluorene-9-spiro-3-(6-dimethylamino) phthalide, 3,6-bis(dimethylamino)-9-spiro [fluorene-9,6-6H-chromeno (4,3-b) indole], 3,6-bis(dimethylamino)-3-methyl-spiro [fluorene-9,6-6H-chromeno (4,3-b) indole], 3,6-bis(diethylamino)-3-methyl-spiro [fluorene-9,6-6H-chromeno (4,3-b) indole] etc.;

triaryl methane compounds such as 3,3-bis(4-dimethylaminophenyl)-6-dimethyl aminophthalide, 3,3-bis(4-dimethylaminophenyl) phthalide, 3-(4-dimethylaminophenyl)-3-(4-diethylaminophenyl)-6-dimethyl aminophthalide, 3-(4-dimethylaminophenyl)-3-(1-methylpyrrol-3-yl)-6-dimethyl aminophthalide etc.; and diaryl methane compounds such as 4,4-bis-dimethyl aminobenzhydrinbenzyl ether, N-halophenyl leucoauramine, and N-2,4,5-trichlorophenyl leucoauramine. Generally, a dye giving a heat-sensitive recording material to easily stain by heating, light, humidity etc. is not preferable even if it is excellent in qualities such as coloration in the heat-sensitive recording material, and a dye giving a recorded image to easily disappear is not preferable either even if the heat-sensitive recording material hardly stains under such environment. Accordingly, particularly preferable among the dyes described above are 3-N,N-dibutylamino-6-methyl-7-anilinofluoran, 3-N,N-diethylamino-6-methyl-7-anilinofluoran, 3-N,N-diamylamino-6-methyl-7-anilinofluoran, 3-N,N-diethylamino-7-(m-trifluoromethylanilino)fluoran, 3-(N-isoamyl-N-ethyl)amino-6-methyl-7-anilinofluoran, 3-(N-p-tolyl-N-ethyl)amino-6-methyl-7-anilinofluoran, 3-(N-isopentyl-N-ethyl)amino-6-methyl-7-anilinofluoran, 3-(N-cyclohexyl-N-methyl)amino-6-methyl-7-anilinofluoran, 3-N,N-diethylamino-6-chloro-7-anilinofluoran and 3,3-bis(4-dimethylaminophenyl)-6-dimethylaminophthalide because these dyes when used in combination with the sensitizer described above and a developer dye described later are very excellent in coloration and shelf stability.

These dyes may be used alone or as a mixture of two or more thereof for the purpose of regulating the color tone of colored images and obtaining a multicolor heat-sensitive recording material.

The amount of the dye used is preferably 10 to 500 parts by weight, more preferably 20 to 400 parts by weight, most preferably 30 to 200 parts by weight, based on 100 parts by weight of the sensitizer. When the amount of the dye used is less than 10 parts by weight, coloring properties that should be inherent in the heat-sensitive recording material cannot be exhibited, while an amount of higher than 500 parts by weight is economically wasteful because no more improvement in coloring properties can be achieved.

The developer includes conventionally known developers, for example phenolic compounds, sulfone compounds, sulfur-based compounds, nitrogenous compounds and salicylate compounds.

Preferable examples include 2,2-bis(4-hydroxyphenyl) propane, 2,2-dimethyl-1,3-bis(4-hydroxybenzoyloxy)propane, 4,4'-cyclohexylidene diphenol, and a reaction mixture of toluene diisocyanate, diaminodiphenyl sulfone and phenol, 4-hydroxy-4'-isopropoxy-diphenyl sulfone, 4,4'-dihydroxy diphenyl sulfone, 2,4'-dihydroxy diphenyl sulfone, 3,3'-diallyl-4,4'-dihydroxy diphenyl sulfone, 4-hydroxy-4'-allyloxy diphenyl sulfone, 4-benzyloxy-4'-hydroxy diphenyl sulfone, and a dehydration condensate of a 2,2-bis(hydroxymethyl)-1,3-propane diol polycondensate and 4-hydroxybenzoic acid, 2,4-bis(phenylsulfonyl)phenol, 2,4-bis(phenylsulfonyl)-5-methyl phenol, 4,4'-[oxybis(ethyleneoxy-p-phenylenesulfonyl)] diphenol, α,α'-bis{(4-p-hydroxyphenylsulfone) phenoxy}-p-xylene, 1,5-bis(4-hydroxyphenylthio)-3-oxapentane, 1,8-bis(4-hydroxyphenylthio)-3,6-dioxaoctane, 4,4'-bis(p-toluene sulfonylaminocarbonylamino)-diphenyl methane, p-toluene sulfonylaminocarboanilide, bis(4-hydroxyphenylthioethoxy)methane, bis(4-hydroxyphenylthioethyl)ether, 4-hydroxy benzene sulfone anilide, 3,5-di-α-methylbenzyl salicylic acid and its Zn salt, and benzyl 4-hydroxy benzoate.

Particularly preferable among those described above in consideration of coloring properties of the heat-sensitive recording material, the storage stability of recorded images, and staining on the surface thereof, are 4,4'-dihydroxy diphenyl sulfone, 2,4'-dihydroxy diphenyl sulfone, 4-hydroxy-4'-isopropoxy diphenyl sulfone, bis(3-allyl-4-hydroxyphenyl) sulfone, 2,2-bis(4-hydroxyphenyl)propane, bis(4-hydroxyphenylthioethoxy) methane, bis(4-hydroxyphenylthioethyl)ether, 4,4'-cyclohexylidene diphenol, 4-benzyloxy-4'-hydroxy diphenyl sulfone, 4-allyloxy-4'-hydroxy diphenyl sulfone, benzyl p-hydroxybenzoate, 3,5-di(α-methylbenzyl) salicylic acid and its zinc salt, 2,4-bis(phenylsulfonyl)phenol, 2,4-bis(phenylsulfonyl)-5-methyl phenol, 4-hydroxy benzene sulfoanilide, a reaction mixture of toluene diisocyanate, diaminodiphenyl sulfone and phenol, 4,4'-bis(p-toluenesulfonylaminocarbonylamino)-diphenyl methane, p-toluene sulfonyl aminocarboanilide, α,α'-bis{4-(p-hydroxyphenylsulfone) phenoxy}-p-xylene, a dehydration condensate of a 2,2-bis(hydroxymethyl-1,3-propane diol polycondensate and 4-hydroxybenzoic acid, and 4,4'-{oxybis(ethyleneoxy-p-phenylene sulfonyl)}diphenol because these very excellent in respect of combination with the sensitizer and dye described above.

These developers may be used alone or as a mixture of two or more thereof.

The amount of the developer used is preferably 10 to 500 parts by weight, more preferably 30 to 400 parts by weight, still more preferably 50 to 300 parts by weight, based on 100 parts by weight of the sensitizer. When the amount of the developer used is less than 10 parts by weight, coloring properties that should be inherent in the heat-sensitive recording material cannot be satisfied, while an amount of higher than 500 parts by weight is economically wasteful because staining on the background of the recording material is remarkable, and no more improvement in coloring properties can be achieved.

A pigment is used for the purpose of preventing adhesion of residuum to a recording head and further whitening a recording layer, and examples of the pigment include inorganic fine powders of kaolin, silica, amorphous silica, calcined kaolin, zinc oxide, calcium carbonate, aluminum hydroxide, magnesium hydroxide, magnesium carbonate, magnesium sulfate, magnesium oxide, titanium oxide, barium sulfate or synthetic aluminum silicate. Further, organic fine resin powders of a styrene/methacrylic acid copolymer, polystyrene resin, and urea/formalin resin can be used in combination with the pigment described above.

The amount of the pigment is preferably 10 to 2000 parts by weight, more preferably 20 to 1000 parts by weight, based on 100 parts by weight of the dye. When the amount of the pigment is less than 10 parts by weight, the intended object cannot be achieved. On the other hand, when the amount is greater than 2000 parts by weight, coloring properties are deteriorated.

As the adhesive, either a water-soluble resin or a water-dispersible resin can be used. Examples thereof include water-soluble resins such as completely (partially) saponified polyvinyl alcohol, acetoacetyl group-modified polyvinyl alcohol, carboxyl group-modified polyvinyl alcohol, silicon-modified polyvinyl alcohol, butyral-modified polyvinyl alcohol, sulfonic acid group-modified polyvinyl alcohol, polyvinyl pyrrolidone, starch and its derivatives, gum arabic, gelatin, casein, chitosan, methyl cellulose, methoxy cellulose, hydroxyethyl cellulose, carboxymethyl cellulose, hydroxymethyl cellulose, sodium carboxymethyl cellulose, a styrene/acrylic acid copolymer salt, a styrene/maleic anhydride copolymer salt, a methyl vinyl ether/maleic anhydride copolymer salt, and an isopropylene/maleic anhydride copolymer salt, and water-dispersible resins such as vinyl acetate latex, acrylate copolymer latex, methacrylate copolymer latex, vinyl acetate/(meth)acrylate copolymer latex, polyurethane latex, polyvinyl chloride latex, polyvinylidene chloride latex, and styrene/butadiene latex. As a matter of course, these adhesives can be used as a mixture of two or more thereof.

The adhesive is incorporated in an amount of about 2 to 40 wt %, preferably about 5 to 30 wt %, based on the total solids content of the heat-sensitive recording layer. When the amount of the adhesive used is less than 2 wt %, the intended use cannot be attained. On the other hand, when the amount is greater than 2000 parts by weight, coloring properties are deteriorated.

The metallic soap and wax are used for the purpose of preventing sticking upon contact of the heat-sensitive recording material with a recording device or a recording head, and examples thereof include higher fatty acid metal salts such as zinc stearate, calcium stearate and aluminum stearate, natural wax such as candelila wax, rice wax, Japan wax, beeswax, lanoline, montan wax, carnauba wax, ceresin wax, paraffin wax, microcrystalline wax, tallow and coconut oil, polyethylene wax, derivatives of stearic acid etc., and Fischer Tropsch wax. These may be used alone or as a mixture thereof.

As the surfactant and dispersant, the emulsifying dispersant described above in production of the sensitizer dispersion is used.

Examples of the defoaming agent include defoaming agents based on higher alcohol, fatty ester, oil, silicone, polyether, modified hydrocarbon oil, and paraffin.

As the water resistance improver, it is possible to employ, if necessary, 1,1,3-tris(2-methyl-4-hydroxy-5-cyclohexylphenyl)butane, 1,1,3-tris(2-methyl-4-hydroxy-5-tert-butylphenyl)butane, and 4-benzyloxy-4'-2,3-propoxy-diphenyl sulfone.

The light resistance improver can include benzotriazole-based UV absorbers such as 2-(2-hydroxy-5-methylphenyl) benzotriazole, 2-(2-hydroxy-3-tert-butyl-5-methylphenyl)-5-chlorobenzotriazole, 2,2-methylene bis[4-(1,1,3,3-tetramethylbutyl)-6-(2H-benzotriazol-2-yl) phenol] and microcapsulated 2-(2-hydroxy-3-dodecyl-5-methylphenyl) benzotriazole.

A coating of each element constituting the heat-sensitive recording material can be produced by a conventionally known preparative method. That is, each of the dye, developer, pigment, water resistance improver, plasticizer resistance improver, metallic soap, and wax can be ground and dispersed in an aqueous medium containing a surfactant, a defoaming agent and a dispersant by a stirrer or a grinder such as a ball mill, an attritor or a sand grinder such that usually the average particle diameter becomes 5 μm or less, preferably 1.5 μm or less, whereby each dispersion can be prepared. The sensitizer dispersion according to the present invention can be compounded with the respective coating solutions in a predetermined formulation to prepare a coating solution of a heat-sensitive recording layer.

The thus obtained coating solution of a heat-sensitive recording layer can be applied onto the surface of a support by an air knife coater, a blade coater, a bar coater, a rod coater, a gravure coater, a curtain coater or a wire bar and then dried to form a heat-sensitive recording layer.

The amount of the coating solution applied is not particularly limited, and is usually regulated in the range of 0.5 to 50.0 g/m$^2$, preferably 1.0 to 20.0 g/m$^2$, on a dry-weight basis.

As the support, paper (neutral paper, acidic paper), a plastic sheet, synthetic paper, a nonwoven cloth or the like is used.

For increasing coloration sensitivity, an undercoat layer (intermediate layer) may be arranged between the heat-sensitive recording layer and the support. The material of the undercoat layer consists essentially of a pigment, an organic hollow particle and an adhesive.

The pigment is preferably a pigment showing high oil absorption, and examples include calcined kaolin, magnesium carbonate, amorphous silica, aluminum silicate, magnesium silicate, calcium silicate, calcium carbonate, urea/formalin resin fillers, and other porous pigments.

The organic hollow particle is not particularly limited, and examples include resins such as homopolymers or copolymers of monomers such as vinyl chloride, vinylidene chloride, vinyl acetate, methyl acrylate, ethyl acrylate, methyl methacrylate, acrylonitrile, and styrene.

The adhesive includes water-soluble polymers such as gelatin, casein, starch and derivatives thereof, methyl cellulose, ethyl cellulose, hydroxyethyl cellulose, carboxymethyl cellulose, methoxy cellulose, completely (partially) saponified polyvinyl alcohol, carboxy-modified polyvinyl alcohol, acetoacetyl-modified polyvinyl alcohol, silicon-modified polyvinyl alcohol, acrylamide/ethyl acrylate copolymers and styrene/maleic anhydride copolymers, and hydrophobic polymers such as styrene/butadiene resin, styrene/acrylic resin, vinyl acetate resin and acrylic resin. The method of forming the undercoat layer is not particularly limited, and the undercoat layer can be formed in the same manner as described in the method of forming the heat-sensitive recording layer described above.

A protective layer may be arranged on the heat-sensitive recording layer for the purpose of preventing unnecessary coloration due to rubbing, scratching etc. and disappearance of recorded images with a plasticizer. Such protective layer is based on a film-making adhesive, a pigment etc. and compounded if necessary with UV absorber-containing microcapsules or fine UV absorber particles thereby preventing the yellowing on the background or fading of recorded images caused by light. In addition, a fluorescent dye, a lubricant, a colorant etc. can also be contained in the protective layer.

By arranging the protective layer, a heat-sensitive recording material excellent in printing suitability, inking suitability and writing suitability can be obtained.

A layer containing a water-soluble, water-dispersible, radiation-curing or UV-curing resin can be arranged on the protective layer for the purpose of conferring high gloss etc.

The film-forming adhesive includes, for example, carboxy-modified polyvinyl alcohol, acetoacetyl-modified polyvinyl alcohol, silicon-modified polyvinyl alcohol and diacetone-modified polyvinyl alcohol.

When such adhesive is used to form the protective layer, a crosslinking agent is desirably used to further improve the water resistance of the protective layer. The crosslinking agent includes, for example, glyoxazole, dialdehyde compounds such as dialdehyde starch, polyamine compounds such as polyethylene imine, epoxy compounds, polyamide resin, melamine resin, boric acid, borax, magnesium chloride etc.

As the pigment and UV absorber, those used for constituting the heat-sensitive recording layer described above can be used.

The method of forming the protective layer is not particularly limited either, and the protective layer can be formed for example in the same manner as described in the method of forming the heat-sensitive recording layer described above. The amount of the protective layer applied is about 0.5 to 15 $g/m^2$, preferably about 1 to 8 $g/m^2$, on a dry-weight basis. This is because when the amount of the protective layer is 0.5 $g/m^2$, or less the functions of the protective layer are not exhibited, while when the amount is 15 $g/m^2$ or more, coloration sensitivity is lowered.

The heat-sensitive recording material can be provided if necessary with a protective layer on the back of a support, or with a pressure-sensitive adhesive layer consisting essentially of a pressure-sensitive adhesive based on natural rubber, a pressure-sensitive adhesive based on acrylic resin, or a pressure-sensitive adhesive based on styrene/isopropylene block copolymer or two-pack type crosslinked resin, to constitute a pressure-sensitive adhesive paper. In this case, a barrier layer may be arranged between the support and the pressure-sensitive adhesive layer to improve shelf stability.

Further, the heat-sensitive recording material may be provided with a magnetic recording layer on the back of the support to constitute a heat-sensitive/magnetic recording material.

Each layer after application may be subjected to smoothing treatment such as supercalender.

EXAMPLES

Hereinafter, the present invention is described in more detail by reference to the Examples, but the present invention is not limited thereto. The terms "parts" and "%" in the Examples refer to "parts by weight" and "% by weight" respectively unless otherwise specified.

[Production of Emulsified Sensitizer Dispersions]

Example 1

A 350-ml kettle of Clearmix CLM-0.8 manufactured by M Technique Co., Ltd. was charged with 150 parts of 1,2-bis(3-methylphenoxy)ethane, 60 parts of 10% aqueous PVA 205 manufactured by Kuraray Co. Ltd, 1.5 parts of Pelex TR manufactured by Kao Corporation and 88.5 parts of water, and the mixed powder was sufficiently permeated by a spatula with the dispersing water. Then, the main body of a mixer was set in the kettle, and the mixture was heated rapidly to 105° C. The pressure in the kettle was a total pressure of 1.4 $kg/cm^2$. Agitation was initiated and when the number of revolutions reached 18,000 rpm in 30 seconds, agitation was finished. A discharge cock was opened, and the mixture was rapidly cooled through a heat exchanger consisting of a pipe in a coiled form having an inner diameter of 6 mm and a length of 300 cm which was externally cooled with iced water, and as a result the temperature of the dispersion in the outlet was 15° C. This discharged dispersion was introduced into a 500-ml flask equipped with a stirrer and cooled with cold water at 15° C., while the discharge cock of the emulsifying apparatus was regulated such that the temperature of the dispersion became 20° C. or less. Discharge of the whole emulsified dispersion from the Clearmix emulsifying kettle required 20 minutes. After the whole dispersion was introduced, the emulsified dispersion was stirred for 2 hours at 20° C. or less to complete crystallization thereof and then sifted with a testing sifter (opening 20 μm), upon which solids hardly remained on the opening of the screen.

The emulsified dispersion thus obtained was excellent in fluidity, and the average particle diameter was 2.0 μm as determined with a particle-size measuring instrument SALD-2000J manufactured by Shimadzu Corporation. The amount of the resulting dispersion was 290 parts, and the solids content was 52.3%.

Example 2

A 1,000-ml SUS separable flask equipped with a stirrer, a condenser and a thermometer was charged with 120 parts of β-naphthyl benzyl ether, 48 parts of 10% aqueous Goseran L-3266 manufactured by Nippon Synthetic Chemical Industry Co., Ltd., 0.6 part of Emulgen 1118S-70 manufacture by Kao Corporation and 130.8 parts of water, and the mixed powder was permeated sufficiently with the dispersing water, and then the temperature of the kettle was increased to 105° C., and the mixture was stirred at 105° C. for 10 minutes, and the separable flask was removed, then attached to T. K. Homomixer manufactured by Tokushu Kika Kogyo Co., Ltd. and provided with a Teflon (registered trademark) plate as a lid for preventing escape of water vapor from the mixture in the separable flask during emulsification at high temperature, and the mixture was emulsified at 99 to 100° C. at a revolution number of 12,000 rpm for 5 minutes. Then, 120 parts of ice were placed on a 1,000-ml kettle equipped with a stirrer and cooled with iced water, and the above emulsified dispersion was carefully introduced into the kettle such that the internal temperature became 30° C. or less. After introduction, the emulsified dispersion was stirred at 30° C. or less for 2 hours to complete crystallization thereof. Then, this product was sifted with a testing sifter (opening 20 μm), upon which solids hardly remained on the opening of the screen.

The emulsified dispersion thus obtained was excellent in fluidity, and the average particle diameter thereof was 1.5 μm. The amount of the resulting dispersion was 390 parts, and the solids content was 31.3%.

Example 3

A 350-ml kettle of Clearmix CLM-0.8 manufactured by M Technique Co., Ltd. was charged with 150 parts of 1,2-bis(3-methylphenoxy)ethane, 60 parts of 10% aqueous PVA 205 manufactured by Kuraray Co. Ltd, 1.5 parts of Pelex TR manufactured by Kao Corporation and 88.5 parts of water, and the mixed powder was sufficiently permeated by a spatula with the dispersing water. Then, the main body of a mixer was set in the kettle, and the mixture was heated rapidly to 105° C. The pressure in the kettle was a total pressure of 1.4 kg/cm$^2$. Agitation was initiated and the number of revolutions reached 18,000 rpm in 30 seconds. The mixture was stirred for additional 60 seconds at the same number of revolutions.

A discharge cock was opened, and the mixture was rapidly cooled through a heat exchanger consisting of a pipe in a coiled form having an inner diameter of 6 mm and a length of 300 cm which was externally cooled with iced water, and as a result the temperature of the dispersion in the outlet was 15° C. This discharged dispersion was introduced into a 500-ml flask equipped with a stirrer and cooled with cold water at 15° C., while the discharge cock of the emulsifying apparatus was regulated such that the temperature of the dispersion became 20° C. or less. Discharge of the whole emulsified dispersion from the Clearmix emulsifying kettle required 20 minutes. After the whole dispersion was introduced, the emulsified dispersion was stirred for 2 hours at 20° C. or less to complete crystallization thereof and then sifted with a testing sifter (opening 20 μm), upon which solids hardly remained on the opening of the screen.

The emulsified dispersion thus obtained was excellent in fluidity, and the average particle diameter thereof was 1.0 μm. The amount of the resulting dispersion was 291 parts, and the solids content was 52.2%.

Example 4

A 350-ml kettle of Clearmix CLM-0.8 manufactured by M Technique Co., Ltd. was charged with 150 parts of 1,2-bis(3-methylphenoxy)ethane, 60 parts of 10% aqueous PVA 205 manufactured by Kuraray Co. Ltd, 1.5 parts of Pelex TR manufactured by Kao Corporation and 88.5 parts of water, and the mixed powder was sufficiently permeated by a spatula with the dispersing water. Then, the main body of a mixer was set in the kettle, and the mixture was heated rapidly to 105° C. The pressure in the kettle was a total pressure of 1.4 kg/cm$^2$. Agitation was initiated and the number of revolutions reached 18,000 rpm in 30 seconds. The mixture was stirred for additional 60 seconds at the same number of revolutions.

A discharge cock was opened, and the mixture was passed through a heat exchanger consisting of a pipe in length in a coiled form having an inner diameter of 6 mm and a length of 50 cm dipped in hot water at 95° C., and then introduced under stirring at a kettle temperature of 30° C. or less into a 1,000-ml kettle containing 200 parts of the emulsified dispersion obtained in Example 3 cooled externally to 5° C. with iced water. After the discharge was finished, the emulsified dispersion was stirred for 2 hours at 30° C. or less to complete crystallization thereof and then sifted with a testing sifter (opening 20 μm), upon which solids hardly remained on the opening of the screen.

The emulsified dispersion thus obtained was excellent in fluidity, and the average particle diameter thereof was 1.0 μm. The amount of the resulting dispersion was 485 parts, and the solids content was 52.3%.

Example 5

A 350-ml kettle of Clearmix CLM-0.8 manufactured by M Technique Co., Ltd. was charged with 150 parts of 1,2-bis(3-methylphenoxy)ethane, 45 parts of 10% aqueous PVA 205 manufactured by Kuraray Co. Ltd, 0.15 part of Pelex TR manufactured by Kao Corporation and 105 parts of water, and the mixed powder was sufficiently permeated by a spatula with the dispersing water. Then, the main body of a mixer was set in the kettle, and the mixture was heated rapidly to 105° C. The pressure in the kettle was a total pressure of 1.4 kg/cm$^2$. Agitation was initiated and the number of revolutions reached 18,000 rpm in 30 seconds. The mixture was stirred for additional 60 seconds at the same number of revolutions.

A thermometer, a stirrer and a condenser were attached to a 1,000-ml receiving receiver of a PEL-20 container manufactured by Nanomizer, and 205 parts of water were introduced into the receiver and heated to 100° C. with a mantle heater, while the main body of from the receiver through a generation part to a discharge part was heated with a RIBOSHI heater such that the temperature of a contacting part at the side of the main body became 105° C. Further, a heat exchanger consisting of a pipe in a coiled form having an inner diameter of 6 mm and a length of 50 cm, dipped in hot water at 95° C., was attached to the discharge part of the main body of the Nanomizer. Then, the outlet of the heat exchanger was inserted into a 1,000-ml emulsified dispersion-storing flask dipped in an iced water bath, and 99 parts of ice and 1 part of 10% aqueous PVA 205 manufactured by Kuraray Co. Ltd were introduced into the 1,000-ml emulsified dispersion-storing flask and cooled to 5° C. under stirring.

Then, the discharge cock was opened, and the dispersion emulsified with Clearmix was discharged and introduced under stirring into the Nanomizer receiver.

Then, the operation of Nanomizer was initiated under one-pass conditions at 400 kg/cm$^2$. The Nanomizer was actuated and regulated such that the inner temperature of the emulsified dispersion-storing flask became 30° C. or less, and 20 minutes were required until the operation was finished.

After the operation was finished, the emulsified dispersion was stirred for 2 hours in the emulsified dispersion-storing flask at an inner temperature of 30° C. or less to complete crystallization. Then, this product was sifted with a testing sifter (opening 20 μm), upon which solids hardly remained on the opening of the screen.

The emulsified dispersion thus obtained was excellent in fluidity, and the average particle diameter thereof was 0.3 μm. The amount of the resulting dispersion was 480 parts, and the solids content was 31.0%.

Example 6

A 500-ml kettle of Clearmix CLM-1.5/2.2W manufactured by M Technique Co., Ltd. was charged with 210 parts of 1,2-bis(3-methylphenoxy)ethane, 84 parts of 10% aqueous PVA 205 manufactured by Kuraray Co. Ltd, 2.1 parts of Pelex TR manufactured by Kao Corporation and 123.9 parts of water, and the mixed powder was sufficiently permeated by a spatula with the dispersing water. Then, the main body of a mixer was set in the kettle, and the mixture was heated rapidly to 105° C. The pressure in the kettle was a total pressure of 1.4 kg/cm$^2$. Agitation was initiated and the number of revolutions became 18,000 rpm in the rotor side and 16,000 rpm in the screen side in 60 seconds. The mixture was stirred for additional 120 seconds at the same number of revolutions. A discharge cock was opened, and the mixture was passed through a pipe having an inner diameter of 6 mm and a length of 20 cm and introduced into a cooling bath (*) such that the temperature of the cooling bath became 20° C. or less while the discharge cock of the emulsifying apparatus was regulated. Discharge of the whole emulsified dispersion from the Clearmix emulsifying kettle required 10 minutes. After the whole dispersion was introduced, the emulsified dispersion was stirred for 2 hours at 20° C. or less to complete crystallization thereof and then sifted with a testing sifter (opening 20 μm), upon which solids hardly remained on the opening of the screen. The emulsified dispersion thus obtained was excellent in fluidity, and the average particle diameter thereof was 0.3 μm. The amount of the resulting dispersion was 686 parts, and the solids content was 31.5%.

The cooling bath (*) is a bath equipped with a stirrer and a thermometer, having a 1000-ml kettle cooled with 280 parts of ice placed in the kettle.

Examples 7 to 10

The same procedure as in Example 3 was carried out except that the sensitizer, the dispersant, the temperature and the total pressure were changed as follows. The results are shown in Table 3.

TABLE 3

| | Sensitizer | Dispersant |
|---|---|---|
| Example 7 | 1,2-bis(phenoxy)ethane<br>150 parts | 60 parts of 10% aqueous PVA-117 manufactured by Kuraray Co. Ltd<br>0.7 part of Poise manufactured by Kao |
| Example 8 | p-benzyl biphenyl<br>150 parts | 60 parts of 10% aqueous Goseran L-3266 manufactured<br>by Nippon Synthetic Chemical Corp.<br>0.7 part of Arastar manufactured by Arakawa Corp. |
| Example 9 | di-p-methybenzyl oxalate<br>150 parts | 60 parts of 10% aqueous Metrose 60SH-03 manufactured<br>by Shin-Etsu Chemical Co. Ltd.<br>0.7 parts of Emulgen manufactured by Kao Corp. |
| Example 10 | 1,2-bis(4-methylphenoxy)ethane<br>150 parts | 60 parts of 5% aqueous PTA-217-EE manufactured by Kuraray Co. Ltd<br>0.3 part of Emul manufactured by Kao Corp. |

| | Temperature (° C.) | Total pressure (kg/cm$^2$) | Fluidity | Average particle diameter (μm) | Amount of the resultant dispersion (parts) | Solids content (%) |
|---|---|---|---|---|---|---|
| Example 7 | 105 | 1.4 | good | 1.0 | 292 | 52.3 |
| Example 8 | 105 | 1.4 | good | 1.0 | 290 | 52.2 |
| Example 9 | 105 | 1.4 | good | 1.0 | 291 | 52.3 |
| Example 10 | 128 | 4.0 | good | 1.0 | 290 | 52.2 |

Comparative Example 1

A 400 ml pot of Sand Grinder TSG4H manufactured by Igarashi Kikai Seizo Corp. was charged with 50 parts of 1,2-bis(3-methylphenoxy) ethane, 20 parts of 10% aqueous PVA 205 manufactured by Kuraray Co. Ltd, 0.25 part of Pelex TR manufactured by Kao Corporation, 0.25 part of 5% aqueous Nopuko 1407-K manufactured by Sannopuko Co., Ltd., and 54.5 parts of water, and the mixed powder was sufficiently permeated by a spatula with the dispersing water and then left for 2 hours. Then, the pot was charged with 250 parts of glass beads EGB501MM (beads diameter 0.85 to 1.18 mm) manufactured by Potters Ballotini Ltd., and then equipped with a 3-stage blade, and milling was initiated at a revolution number of 1,000 rpm while water at 20° C. was circulated through a pot jacket. The particle diameter was measured with time by a particle diameter measuring instrument manufactured by SALD-2000J manufactured by Shimadzu Corporation, and after 1.5 hours, the average particle diameter became 2.0 μm.

This dispersion was sifted with a testing sifter (opening 20 μm) manufactured by Iida Corp., to give 83 parts of 1,2-bis (3-methylphenoxy) ethane having an average particle diameter of 2.0 μm. The solids content of this dispersion was 41.8%.

Comparative Example 2

A 400-ml pot of Sand Grinder TSG4H manufactured by Igarashi Kikai Seizo Corp. was charged with 50 parts of 1,2-bis(3-methylphenoxy) ethane, 20 parts of 10% aqueous PVA 205 manufactured by Kuraray Co. Ltd, 0.25 part of Pelex TR manufactured by Kao Corporation, 0.25 part of 5% aqueous Nopuko 1407-K manufactured by Sannopuko Co., Ltd., and 54.5 parts of water, and the mixed powder was sufficiently permeated by a spatula with the dispersing water and then left for 2 hours. Then, the pot was charged with 250 parts of glass beads EGB501MM (beads diameter 0.85 to 1.18 mm) manufactured by Potters Ballotini Ltd., and then equipped with a 3-stage blade, and milling was initiated at a revolution number of 1,000 rpm while water at 20° C. was circulated through a pot jacket. The particle diameter was measured with time by a particle diameter measuring instrument manufactured by SALD-2000J manufactured by Shimadzu Corporation, and after 3 hours, the average particle diameter became 1.0 μm.

This dispersion was sifted with a testing sifter (opening 20 μm) manufactured by Iida Corp., to give 80 parts of 1,2-bis (3-methylphenoxy) ethane having an average particle diameter of 1.0 μm. The solids content of this dispersion was 41.8%.

Comparative Example 3

A 400-ml pot of Sand Grinder TSG4H manufactured by Igarashi Kikai Seizo Corp. was charged with 60 parts of the 1,2-bis(3-methylphenoxy)ethane dispersion obtained in Comparative Example 2, 20 parts of water, 0.10 part of 5% aqueous Nopuko 1407-K manufactured by Sannopuko Co., Ltd., and 180 parts of glass beads EGB190MM (beads diameter 0.425 to 0.600 mm) manufactured by Potters Ballotini Ltd., and then equipped with a 3-stage blade, and milling was initiated at a revolution number of 1,000 rpm while water at 20° C. was circulated through a pot jacket. The particle diameter was measured with time by a particle diameter measuring instrument manufactured by SALD-2000J manufactured by Shimadzu Corporation, and after 5 hours, the average particle diameter became 0.3 μm.

This dispersion was sifted with a testing sifter (opening 20 μm) manufactured by Iida Corp., to give 40 parts of 1,2-bis (3-methylphenoxy) ethane having an average particle diameter of 0.3 μm. The solids content of this dispersion was 31.4%.

Comparative Example 4

A 350-ml kettle of a Clearmix CLM-0.8 manufactured by M Technique Co., Ltd. was charged with 150 parts of 1,2-bis (3-methylphenoxy)ethane, 60 parts of 10% aqueous PVA 205 manufactured by Kuraray Co. Ltd, 1.5 parts of Pelex TR manufactured by Kao Corporation and 88.5 parts of water, and the mixed powder was sufficiently permeated by a spatula with the dispersing water. Then, the main body of a mixer was set in the kettle, and the mixture was heated rapidly to 105° C. The pressure in the kettle was a total pressure of 1.4 kg/cm$^2$. Agitation was initiated and when the number of revolutions reached 18,000 rpm in 30 seconds, and the mixture was stirred at the same revolution number for additional 60 seconds.

Then, a discharge cock was opened, and the mixture was introduced into a 500-ml flask dipped in a water bath at 20° C., but the temperature of the kettle was increased to 70° C., and the mixture in the kettle became thick to make stirring impossible. When this product observed under a microscope (×1,000, BH-2 manufactured by Olympus Corp.), needle-shaped gigantic crystals were observed, and spherical particles of about 1 μm were hardly observed, and the emulsification was destroyed. The solids content of this dispersion was 52.5%.

[Productivity of Sensitizer Dispersions]

The method of producing the sensitizer dispersion by the present invention, and the conventional sand grinder method, are shown in Table 4.

TABLE 4

| | Method | Kettle volume (ml) | Amount of sensitizer (parts) | Treatment time (min) | Average particle diameter (μm) |
|---|---|---|---|---|---|
| Example 1 | Clearmix | 350 | 150 | 0.5 | 2.0 |
| Example 2 | Homomixer | 1,000 | 120 | 5 | 1.5 |
| Examples 3 and 7 to 10 | Clearmix | 350 | 150 | 1.5 | 1.0 |
| Example 4 | Clearmix | 350 | 150 | 1.5 | 1.0 |
| Example 5 | Clearmix & Nanomizer | 350<br>1,000 | 150<br>150 | 1.5<br>20 | 0.3 |
| Example 6 | Clearmix | 500 | 210 | 3.0 | 0.3 |
| Comparative Example 1 | Sand grinder | 400 | 50 | 90 | 2.0 |
| Comparative Example 2 | Sand grinder | 400 | 50 | 180 | 1.0 |
| Comparative Example 3 | Sand grinder (1) | 400 | 50 | 180 | 0.3 |
| | Sand grinder (2) | 400 | 50 | 300 | |

As can be seen from Table 4, the method of the present invention is a highly efficient method of finely dividing a sensitizer.

As can also be seen from Examples 1 to 10 and Comparative Example 4, the emulsified dispersion stabilized according to the present invention is obtained by crystallizing, under rapid cooling, the emulsified dispersion of the thermally melted sensitizer to confer the dispersion with excellent fluidity.

[Shelf Stability of the Sensitizer Dispersions]

Example 11

20 parts of the sensitizer dispersion obtained in each of Examples 1 to 10 and Comparative Examples 1 to 3 were placed in a 30-ml sample bottle manufactured by Nichiden-Rika Glass Corp., and then stored at room temperature for 30 days. Then, the following sedimentation test was conducted, and the evaluation was shown in Table 5.

(Evaluation Method)

○: Sedimentation in a fluffy state hardly requiring power for dissociation.

Δ: Firmly set sedimentation requiring agitation with a spatula several times for dissociation.

x: Rigidly set sedimentation requiring agitation with a spatula many times for dissociation.

TABLE 5

| | Average particle diameter (μm) | Evaluation |
|---|---|---|
| Example 1 | 2.0 | ○ |
| Example 2 | 1.5 | ○ |
| Example 3 | 1.0 | ○ |
| Example 4 | 1.0 | ○ |
| Example 5 | 0.3 | ○ |
| Example 6 | 0.3 | ○ |
| Example 7 | 1.0 | ○ |
| Example 8 | 1.0 | ○ |
| Example 9 | 1.0 | ○ |
| Example 10 | 1.0 | ○ |
| Comparative Example 1 | 2.0 | x |
| Comparative Example 2 | 1.0 | Δ~x |
| Comparative Example 3 | 0.3 | ○ |

It is evident that the products of the present invention are excellent in shelf stability regardless of the average particle diameter of the dispersion.

[Production of Heat-Sensitive Recording Material]

Example 12

Preparation of an Undercoat Layer Coating Solution 80 parts of calcined kaolin (trade name: Ansilex, manufactured by EC), 20 parts of calcium carbonate (trade name: Unibar 70, manufactured by Shiraishi Kogyo Kaisha, Ltd.), 140 parts of 5% aqueous polyvinyl alcohol (trade name: PVA117, manufactured by Kuraray Co. Ltd), 15 parts of 48% styrene/butadiene latex, 2 parts of 20% aqueous poly(sodium acrylate) and parts of water were mixed with one another under stirring to give an undercoat layer coating solution.

[Preparation of a Heat-Sensitive Recording Layer Coating Solution]

(Preparation of a Sensitizer Dispersion)

10 parts of the emulsified 1,2-bis(3-methylphenoxy)ethane dispersion obtained in Example 1 were diluted to a sensitizer concentration of 30% with 6.7 parts of water.

(Preparation of a Developer Dispersion)

30 parts of 4-hydroxy-4'-isopropoxy diphenyl sulfone were ground in 70 parts of 5% aqueous methyl cellulose (trade name: Metrose 60SH-03, manufactured by Shin-Etsu Chemical Co., Ltd.) with a sand grinder (Sand Grinder TSG4H manufactured by Igarashi Kikai Seizo Corp.) to give a dispersion having an average particle diameter of 1.0 μm. Then, this product was sifted with a testing sifter (opening 20 μm) to give a developer dispersion.

(Preparation of a Dye Dispersion)

30 parts of 3-N,N-dibutylamino-6-methyl-7-anilinofluoran were ground in 70 parts of 5% aqueous PVA 117 manufactured by Kuraray Co. Ltd with a sand grinder (Sand Grinder TSG4H manufactured by Igarashi Kikai Seizo Corp.) to give a dispersion having an average particle diameter of 1.0 μm. Then, this product was sifted with a testing sifter (opening 20 μm) to give a dye dispersion.

(Preparation of a Pigment Dispersion)

30 parts of Unibar 70, 69 parts of water and 1.0 part of 40% aqueous sodium hexamethaphosphate were stirred at a revolution number of 5,000 rpm (TK Homodisper L, manufactured by Tokushu Kika Kogyo) for 5 minutes to give a pigment dispersion.

(Preparation of a Heat-Sensitive Recording Layer Coating Solution)

7.2 parts of the sensitizer dispersion, 7.2 parts of the developer dispersion, 3.6 parts of the dye dispersion, 7.2 parts of the pigment dispersion, 1.8 parts of 30% zinc stearate emulsion (trade name: Higholin Z-7, manufactured by Chukyo Yushi Co., Ltd.) as a lubricant dispersion, and 21.6 parts of 5% aqueous polyvinyl alcohol (trade name: PVA117, manufactured by Kuraray Co. Ltd) were mixed with one another to give a heat-sensitive recording layer coating solution.

(Preparation of Heat-Sensitive Recording Material)

The undercoat layer coating solution and the heat-sensitive recording layer coating solution were applied in amounts of 10 g/m$^2$ and 3 g/m$^2$ respectively by a wire bar onto one side of 64 g/m$^2$ high-quality neutral paper, whereby a heat-sensitive recording material was obtained. Each layer was formed and subjected to supercalender.

Example 13

A heat-sensitive recording material was obtained in the same manner as in Example 12 except that a sensitizer dispersion produced by diluting 10 parts of the emulsified 1,2-bis(3-methylphenoxy)ethane dispersion obtained in Example 4 to a concentration of 30% with 6.7 parts of water was used in place of the sensitizer dispersion used in Example 12.

Example 14

A heat-sensitive recording material was obtained in the same manner as in Example 12 except that the emulsified 1,2-bis(3-methylphenoxy)ethane dispersion obtained in Example 5 was used as it was in place of the sensitizer dispersion used in Example 12.

Example 15

A heat-sensitive recording material was obtained in the same manner as in Example 12 except that the emulsified 1,2-bis(3-methylphenoxy)ethane dispersion obtained in Example 6 was used as it was in place of the sensitizer dispersion used in Example 12.

Example 16

A heat-sensitive recording material was obtained in the same manner as in Example 12 except that the following sensitizer/developer mixed dispersion and the following heat-sensitive recording layer coating solution were used in place of the sensitizer dispersion, the developer dispersion and the heat-sensitive recording layer coating solution used in Example 12.

(Preparation of a Sensitizer/Developer Mixed Dispersion)

100 parts of the emulsified 1,2-bis(3-methylphenoxy) ethane dispersion obtained in Example 4, 50 parts of 4-hydroxy-4'-isopropoxy diphenyl sulfone, 100 parts of water and 0.5 part of 5% aqueous Nopuko 1407-K manufactured by Sannopuko Co., Ltd. were introduced into a 1,000-ml pot of Sand Grinder TSG4H manufactured by Igarashi Kikai Seizo Corp., dispersed and smeared with water by a spatula and left for 2 hours.

Then, the pot was charged with 500 parts of glass beads EGB501MM (beads diameter 0.85 to 1.18 mm) manufactured by Potters Ballotini Ltd., and then equipped with a 3-stage blade, and milling was initiated at a revolution number of 1,000 rpm while water at 20° C. was circulated through a pot jacket.

The particle diameter was measured with time by a particle diameter measuring instrument manufactured by SALD-2000J manufactured by Shimadzu Corporation, and after 45 minutes, the average particle diameter became 1.0 μm.

This dispersion was sifted with a testing sifter (opening 20 μm) to give 140 parts of a dispersion having an average particle diameter of 1.0 μm with a solids content of 40.8% consisting of a mixture of 1,2-bis(3-methylphenoxy)ethane and 4-hydroxy-4'-isopropoxy diphenyl sulfone (100:100).

Then, 20 parts of this dispersion were diluted with 6.6 parts of water to give a sensitizer/developer mixed dispersion.

(Preparation of a Heat-Sensitive Recording Layer Coating Solution)

14.4 parts of the sensitizer/developer mixed dispersion, 3.6 parts of the dye dispersion, 7.2 parts of the pigment dispersion, 1.8 parts of 30% zinc stearate emulsion (trade name: Higholin Z-7, manufactured by Chukyo Yushi Co., Ltd.) as a lubricant dispersion, and 21.6 parts of 5% aqueous polyvinyl alcohol (trade name: PVA117, manufactured by Kuraray Co. Ltd) were mixed with one another to give a heat-sensitive recording layer coating solution.

Example 17

A heat-sensitive recording material was obtained in the same manner as in Example 12 except that the following sensitizer/dye mixed dispersion and the following heat-sensitive recording coating solution were used in place of the sensitizer dispersion, the developer dispersion and the heat-sensitive recording layer coating solution used in Example 12.

(Preparation of a Sensitizer/Dye Mixed Dispersion)

100 parts of the emulsified 1,2-bis(3-methylphenoxy) ethane dispersion obtained in Example 4, 25 parts of 3-N,N-dibutylamino-6-methyl-7-anilionofluoran, 62 parts of water and 0.5 part of 5% aqueous Nopuko 1407-K manufactured by Sannopuko Co., Ltd. were introduced into a 1,000-ml pot of Sand Grinder TSG4H manufactured by Igarashi Kikai Seizo Corp., dispersed and smeared with the water by a spatula and left for 2 hours.

Then, the pot was charged with 375 parts of glass beads EGB501MM (beads diameter 0.85 to 1.18 mm) manufactured by Potters Ballotini Ltd., and then equipped with a 3-stage blade, and milling was initiated at a revolution number of 1,000 rpm while water at 20° C. was circulated through a pot jacket.

The particle diameter was measured with time by a particle diameter measuring instrument manufactured by SALD-2000J manufactured by Shimadzu Corporation, and after 45 minutes, the average particle diameter became 1.0 μm.

This dispersion was sifted with a testing sifter (opening 20 μm) to give 125 parts of a dispersion having an average particle diameter of 1.0 μm with a solids content of 41.0% consisting of a mixture of 1,2-bis(3-methylphenoxy)ethane and 3-N,N-dibutylamino-6-methyl-7-anilinofluoran (100:50).

Then, 20 parts of this dispersion were diluted with 6.6 parts of water to give a sensitizer/dye mixed dispersion.

(Preparation of a Heat-Sensitive Recording Layer Coating Solution)

10.8 parts of the sensitizer/dye mixed dispersion, 7.2 parts of the developer dispersion, 7.2 parts of the pigment dispersion, 1.8 parts of 30% zinc stearate emulsion (trade name: Higholin Z-7, manufactured by Chukyo Yushi Co., Ltd.) as a lubricant dispersion, and 21.6 parts of 5% aqueous polyvinyl alcohol (trade name: PVA117, manufactured by Kuraray Co. Ltd) were mixed with one another to give a heat-sensitive recording layer coating solution.

Example 18

A heat-sensitive recording material was obtained in the same manner as in Example 12 except that a sensitizer dispersion produced by diluting 10 parts of the emulsified 1,2-bis(phenoxy)ethane dispersion obtained in Example 7 to a concentration of 30% with 6.7 parts of water was used in place of the sensitizer dispersion used in Example 12.

Example 19

A heat-sensitive recording material was obtained in the same manner as in Example 12 except that a sensitizer dispersion produced by diluting 10 parts of the emulsified p-benzyl biphenyl dispersion obtained in Example 8 to a concentration of 30% with 6.7 parts of water was used in place of the sensitizer dispersion used in Example 12.

Example 20

A heat-sensitive recording material was obtained in the same manner as in Example 12 except that a sensitizer dispersion produced by diluting 10 parts of the emulsified di-p-methyl benzyl oxalate dispersion obtained in Example 9 to a concentration of 30% with 6.7 parts of water was used in place of the sensitizer dispersion used in Example 12.

Example 21

A heat-sensitive recording material was obtained in the same manner as in Example 12 except that a sensitizer dispersion produced by diluting 10 parts of the emulsified 1,2-bis(4-methylphenoxy)ethane dispersion obtained in Example 10 to a concentration of 30% with 6.7 parts of water was used in place of the sensitizer dispersion used in Example 12.

Comparative Example 5

A heat-sensitive recording material was obtained in the same manner as in Example 12 except that a sensitizer dispersion produced by diluting 10 parts of the emulsified 1,2-bis(3-methylphenoxy)ethane dispersion obtained in Comparative Example 1 to a concentration of 30% with 3.3 parts of water was used in place of the sensitizer dispersion used in Example 12.

Comparative Example 6

A heat-sensitive recording material was obtained in the same manner as in Example 12 except that a sensitizer dispersion produced by diluting 10 parts of the emulsified 1,2-bis(3-methylphenoxy)ethane dispersion obtained in Comparative Example 2 to a concentration of 30% with 3.3 parts of water was used in place of the sensitizer dispersion used in Example 12.

Comparative Example 7

A heat-sensitive recording material was obtained in the same manner as in Example 12 except that a sensitizer dispersion produced by diluting 10 parts of the emulsified 1,2-bis(3-methylphenoxy)ethane dispersion obtained in Comparative Example 3 to a concentration of 30% with 3.3 parts of water was used in place of the sensitizer dispersion used in Example 12.

Comparative Example 8

A heat-sensitive recording material was obtained in the same manner as in Example 12 except that a sensitizer dispersion produced by diluting 10 parts of the emulsified 1,2-bis(3-methylphenoxy)ethane dispersion obtained in Comparative Example 4 to a concentration of 30% with 3.3 parts of water was used in place of the sensitizer dispersion used in Example 12.

[Performance Comparison Test of the Heat-Sensitive Recording Materials]

Then, the heat-sensitive recording material obtained in each of Examples 12 to 21 and Comparative Examples 5 to 8 was examined in a printing test with a thermal head (type KJT-256-8MGFI-ASH, manufactured by Kyocera Corp.) 1653Ω at a printing voltage of 24V, a printing cycle of 0.9 and 1.4 msec. in a heat-sensitive recording material coloring test device (trade name: TH-PMD, manufactured by Ohkura Electric Co., Ltd.), and examined for the following performance.

(1) Background and Print Density

Measured with a Macbeth densitometer (RD-918 manufactured by Macbeth).

(2) Humidity Resistance Test

The sample was left for 24 hours at a temperature of 45° C. under 85% humidity and measured for background and print density with a Macbeth densitometer.

(3) Heat Resistance Test

The sample was left for 24 hours at a temperature of 60° C. and measured for background and print density with a Macbeth densitometer.

The evaluation results are shown in Table 6.

TABLE 6

| | Initial value | | | Humidity resistance | | Heat resistance | |
|---|---|---|---|---|---|---|---|
| | Background | 0.9 (msec) | 1.4 (msec) | Background | 1.4 (msec) | Background | 1.4 (msec) |
| Example 12 | 0.04 | 0.91 | 1.29 | 0.05 | 1.23 | 0.08 | 1.19 |
| Example 13 | 0.04 | 0.95 | 1.32 | 0.05 | 1.27 | 0.08 | 1.23 |
| Example 14 | 0.04 | 1.01 | 1.36 | 0.05 | 1.31 | 0.08 | 1.28 |
| Example 15 | 0.04 | 1.01 | 1.36 | 0.05 | 1.31 | 0.08 | 1.28 |
| Example 16 | 0.04 | 0.99 | 1.35 | 0.05 | 1.30 | 0.08 | 1.27 |
| Example 17 | 0.04 | 1.00 | 1.36 | 0.05 | 1.31 | 0.08 | 1.28 |
| Example 18 | 0.04 | 1.00 | 1.35 | 0.05 | 1.30 | 0.08 | 1.25 |
| Example 19 | 0.04 | 0.92 | 1.30 | 0.05 | 1.25 | 0.10 | 1.23 |
| Example 20 | 0.04 | 0.93 | 1.30 | 0.05 | 1.25 | 0.10 | 1.20 |
| Example 21 | 0.04 | 0.85 | 1.32 | 0.05 | 1.26 | 0.06 | 1.22 |
| Comparative Example 5 | 0.04 | 0.91 | 1.29 | 0.05 | 1.23 | 0.08 | 1.19 |
| Comparative Example 6 | 0.04 | 0.95 | 1.32 | 0.05 | 1.27 | 0.08 | 1.23 |
| Comparative Example 7 | 0.04 | 1.00 | 1.36 | 0.05 | 1.31 | 0.08 | 1.28 |
| Comparative Example 8 | 0.04 | 0.40 | 0.80 | 0.05 | 0.25 | 0.08 | 0.60 |

From Table 6, it is evident that the heat-sensitive recording materials of the present invention are in no way inferior to the conventional heat-sensitive recording materials in respect of the particle diameter of the sensitizer, and when it is considered that a more excellent heat-sensitive recording material is obtained as the particle diameter of the sensitizer is decreased, fine particles of about 0.3 μm which are hardly industrially obtainable in the prior-art method can be obtained inexpensively according to the present invention, so it is understood that a heat-sensitive recording material giving an recorded image excellent in coloration without staining on the background can be more advantageously obtained.

INDUSTRIAL APPLICABILITY

According to the method of producing the sensitizer dispersion of the present invention, a sensitizer for heat-sensitive recording material can be emulsified in a short time to form fine particles, and as compared with the prior-art sensitizer dispersion, the resulting sensitizer dispersion even when used as a coating material for heat-sensitive recording material after kept and stored for a long time can economize significantly on power and time for re-dispersion, can be used to prepare a coating solution always in a short time, and is thus extremely advantageous in producing a heat-sensitive recording material. A heat-sensitive recording material using the resulting sensitizer dispersion is excellent in coloration to give a recorded image excellent in stability during storage, with no or less background fogging under heating and humidity.

The invention claimed is:

1. A method of producing a sensitizer dispersion, which comprises emulsifying and finely dividing a heat-sensitive recording sensitizer by melting under heating in an aqueous emulsifying dispersant, and then crystallizing the finely divided emulsified dispersion under rapid cooling, wherein the sensitizer is at least one member selected from the group consisting of 1,2-bis(phenoxy)ethane, 1,2-bis(3-methylphenoxy)ethane, 1,2-bis(4-methylphenoxy)ethane, p-benzylbiphenyl, di-p-methylbenzyl oxalate, and β-naphthyl benzyl ether.

2. The method of producing a sensitizer dispersion according to claim 1, wherein the emulsified sensitizer dispersion is crystallized under rapid cooling, and the temperature after the rapid cooling is 50° C. or less.

3. The method of producing a sensitizer dispersion according to claim 1, wherein the sensitizer is emulsified and finely divided such that the solids content of a mixture of the sensitizer and the emulsifying dispersant becomes 10 to 65 wt %, and the average particle diameter thereof becomes 3 μm or less.

* * * * *